US005507154A

United States Patent [19]

Grant

[11] Patent Number: 5,507,154

[45] Date of Patent: Apr. 16, 1996

[54] SELF-CALIBRATING DEFROST CONTROLLER

[75] Inventor: Charles D. Grant, Powell, Ohio

[73] Assignee: Ranco Incorporated of Delaware, Wilmington, Del.

[21] Appl. No.: 269,843

[22] Filed: Jul. 1, 1994

[51] Int. Cl.[6] ..... F25D 21/06

[52] U.S. Cl. ..... 62/156; 62/81; 62/151

[58] Field of Search ..... 62/155, 156, 234, 62/82, 151, 160, 81

[56] References Cited

U.S. PATENT DOCUMENTS

| | | | |
|---|---|---|---|
| 4,102,389 | 7/1978 | Wills . | |
| 4,209,994 | 7/1980 | Mueller et al. . | |
| 4,373,349 | 2/1983 | Mueller . | |
| 4,406,133 | 9/1983 | Saunders et al. | 62/156 X |
| 4,439,995 | 4/1984 | McCarty | 62/156 |
| 4,563,877 | 1/1986 | Harnish . | |
| 4,573,326 | 3/1986 | Sulfstede et al. . | |
| 4,590,771 | 5/1986 | Shaffer et al. . | |
| 4,882,908 | 11/1989 | White . | |
| 5,179,841 | 1/1993 | Phillips et al. | 62/156 X |
| 5,237,830 | 8/1993 | Grant . | |
| 5,303,562 | 4/1994 | Bahel et al. . | |
| 5,319,943 | 6/1994 | Bahel et al. . | |

*Primary Examiner*—Harry B. Tanner

*Attorney, Agent, or Firm*—Watts, Hoffmann, Fisher & Heinke Co.

[57] ABSTRACT

A self-calibrating defrost controller for use with heat pump. The outdoor heat exchanger coil of a heat pump is defrosted based upon either compressor run-time exceeding 6 hours, or the temperature difference between the coil and ambient air exceeding a value that changes depending upon outdoor coil temperature. A programmable controller mounted to a printed circuit board within a housing executes a control program to monitor temperature sensor produced temperature signals. One sensor that monitors ambient temperature is mounted to the printed circuit board that also supports the programmable controller.

31 Claims, 9 Drawing Sheets

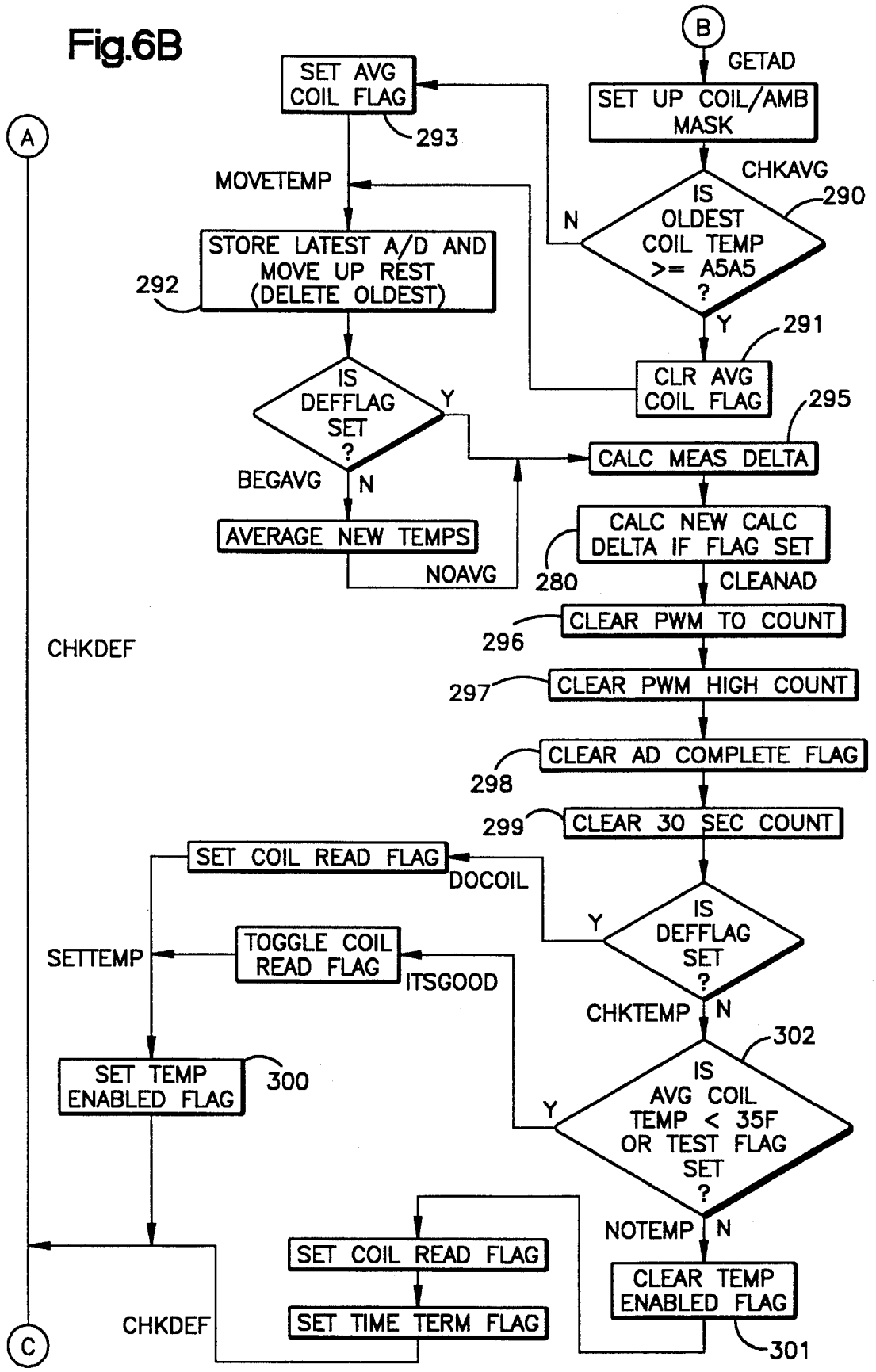
Fig.6B
B
GETAD
SET UP COIL/AMB MASK
CHKAVG
IS OLDEST COIL TEMP >= A5A5 ?
290
N
Y
291
CLR AVG COIL FLAG
SET AVG COIL FLAG
293
MOVETEMP
STORE LATEST A/D AND MOVE UP REST (DELETE OLDEST)
292
IS DEFFLAG SET ?
Y
N
BEGAVG
AVERAGE NEW TEMPS
NOAVG
295
CALC MEAS DELTA
CALC NEW CALC DELTA IF FLAG SET
280
CLEANAD
CLEAR PWM TO COUNT
296
CLEAR PWM HIGH COUNT
297
CLEAR AD COMPLETE FLAG
298
CLEAR 30 SEC COUNT
299
A
CHKDEF
SET COIL READ FLAG
DOCOIL
IS DEFFLAG SET ?
Y
N
CHKTEMP
TOGGLE COIL READ FLAG
SETTEMP
ITSGOOD
SET TEMP ENABLED FLAG
300
302
IS AVG COIL TEMP < 35F OR TEST FLAG SET ?
Y
NOTEMP
N
CLEAR TEMP ENABLED FLAG
301
SET COIL READ FLAG
SET TIME TERM FLAG
CHKDEF
C

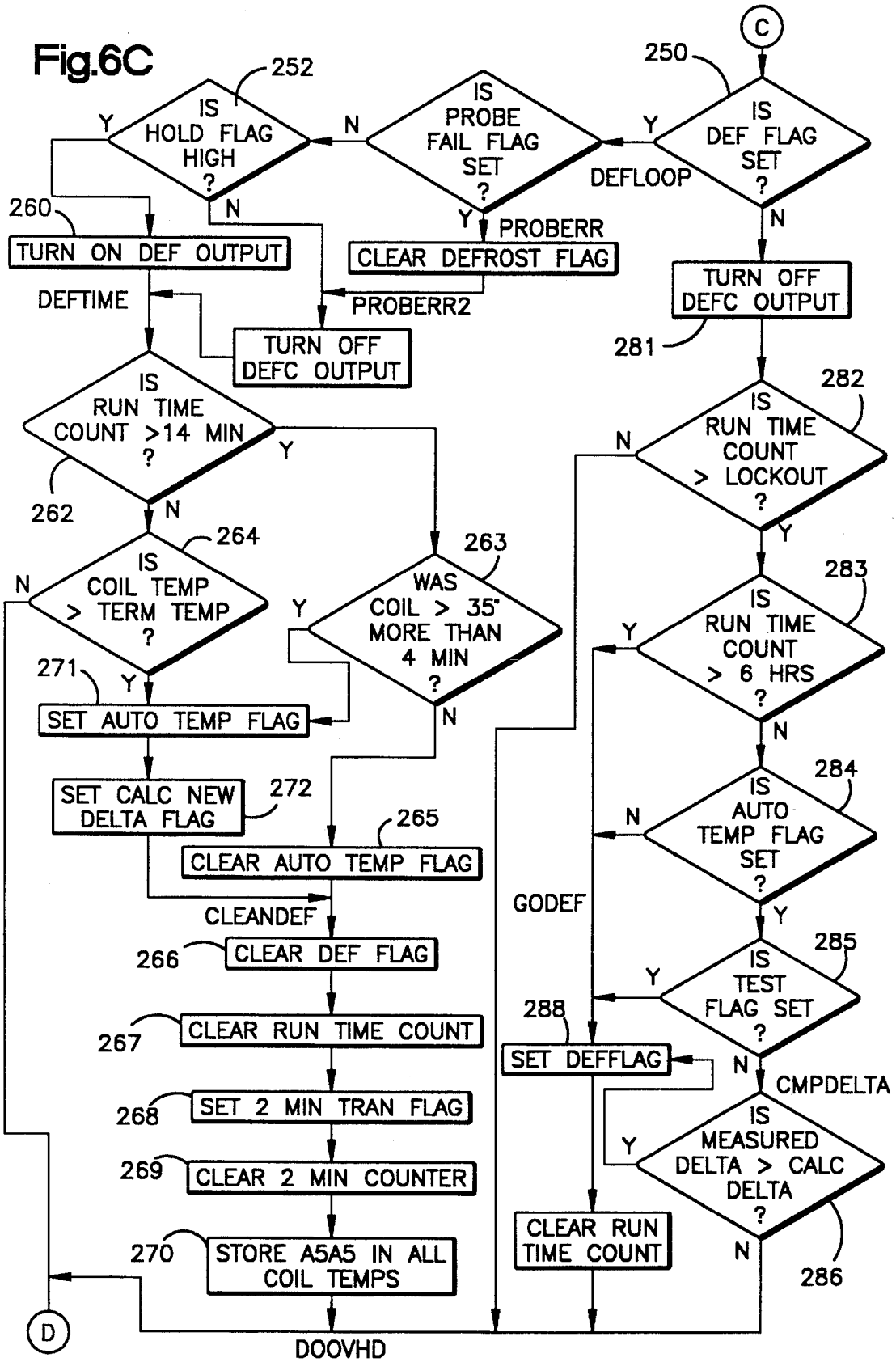
Fig.6C
C
250
IS DEF FLAG SET ?
Y
N
DEFLOOP
IS PROBE FAIL FLAG SET ?
Y
PROBERR
CLEAR DEFROST FLAG
PROBERR2
N
252
IS HOLD FLAG HIGH ?
Y
N
260
TURN ON DEF OUTPUT
DEFTIME
TURN OFF DEFC OUTPUT
281
TURN OFF DEFC OUTPUT
282
IS RUN TIME COUNT > LOCKOUT ?
N
Y
IS RUN TIME COUNT >14 MIN ?
Y
N
262
264
IS COIL TEMP > TERM TEMP ?
N
Y
263
WAS COIL > 35° MORE THAN 4 MIN ?
Y
N
271
SET AUTO TEMP FLAG
283
IS RUN TIME COUNT > 6 HRS ?
Y
N
SET CALC NEW DELTA FLAG
272
265
CLEAR AUTO TEMP FLAG
284
IS AUTO TEMP FLAG SET ?
N
Y
GODEF
CLEANDEF
266
CLEAR DEF FLAG
285
IS TEST FLAG SET ?
Y
N
288
SET DEFFLAG
267
CLEAR RUN TIME COUNT
CMPDELTA
268
SET 2 MIN TRAN FLAG
IS MEASURED DELTA > CALC DELTA ?
Y
N
269
CLEAR 2 MIN COUNTER
CLEAR RUN TIME COUNT
286
270
STORE A5A5 IN ALL COIL TEMPS
D
DOOVHD

SELF-CALIBRATING DEFROST CONTROLLER

FIELD OF THE INVENTION

The present invention concerns a defrost controller for use with a refrigeration system and, more specifically, to a controller for defrosting an outdoor heat exchanger of a heat pump system.

BACKGROUND ART

Different prior art procedures for detecting and controlling the formation of frost or ice on a heat pump outdoor heat exchange coil have been performed with varying degrees of success. These procedures include cyclical de-icing, sensing air pressure drop across the outdoor coil, sensing temperature differences between the air and the outdoor coil, photo-optical responses from the frost (reflectivity), capacitance change due to the frost build-up as well as tactile change due to ice formation on the coil. While some of these methods directly send the formation of frost or ice, others use secondary effects, such as air pressure drop or thermodynamic and heat transfer changes in the system for initiation and/or termination of a de-icing cycle.

One prior art proposal for defrosting makes use of a power factor change of an outdoor fan motor as ice builds up on the outdoor coil. The ice impedes air flow and changes the loading on the fan motor. This system is dependent on motor selection for the fan.

Photo-optical systems have been used which include sensors positioned to view heat exchange fins or tubes on outdoor heat exchange coils and detect the presence of ice by observing changes in reflectivity of a light source. The ability to detect hoar frost and/or glare ice and differentiate the thickness of the ice build-up have been problems for these systems.

Measuring the capacitance of the frost has been tried with minimal success due to the variability of ice, sensitivity of the signal, and critical placement of metal plates between which the frost build-up occurs.

Fluidic sensors use "Coanda principles" in which air is passed through one leg of a flow path and diverted to a second leg when a blockage signal is received. These sensors experience problems associated with dust and dirt clogging the filters protecting the small passages used in the fluidic sensor.

Still other methods employ tactile means of detecting the presence of ice, or employ the freezing effect of ice to increase friction and loading on a movable lever mechanism. These systems can only be employed on certain coil designs and adjustability has been a problem.

Other systems use electromechanically-operated timing devices to start a defrost cycle. They either reverse the refrigerant flow through the outdoor coil, turn on heaters, or blow hot gas over the coil.

These timing systems are simple and reliable. They do not, however, defrost "on demand" and therefor utilize energy for defrosting when there may not be a need to de-ice. An example of one "timed" defrost control system is found in U.S. Pat. No. 5,237,830 to Grant. The disclosure of this patent is incorporated herein by reference.

Use of temperature responsive devices in combination with a clock-operated timer makes the defrosting "permissive". One example of this type of process is to initiate a defrost cycle only when outdoor temperatures fall below 32° F.

Electromechanical timing devices can generally also be programmed for both frequency and duration of the de-ice cycle. A degree of selectability is desirable to accommodate both variations in climate and idiosyncracies of individual heat pumps.

Integration of temperature responsive elements with a clock-drive mechanism offers both cost effectiveness and ease of installation and servicing of the devices. These systems, when properly programmed, will perform reasonably well under most climatic conditions and offer energy savings over the inflexible cyclical defrost procedures.

Defrost systems capable of sensing two temperatures (the outdoor ambient and the outdoor coil temperature) can provide a signal when the insulating effect of frost on the coil causes the air and outdoor coil surface temperature difference to increase to a predetermined value. Such systems provide reasonable performance when properly installed and adjusted. They provide a form of "demand" defrost which is more energy conserving than cyclic heat pump defrost controls.

The effectiveness of defrost systems using the temperature difference between outdoor air and the outdoor heat exchange coil is decreased at low temperatures. At low temperatures, the heat transfer capacity of the heat pump is decreased and a fully frosted heat exchange coil does not deviate as greatly from outdoor air temperature. To activate defrosting at low temperatures, the threshold temperature difference between coil and air temperature must be smaller. Furthermore, the temperature difference between an unfrosted coil and a fully frosted coil is reduced markedly from differentials encountered at higher outdoor air temperatures. This can lead to false defrosting if the coil temperature fluctuates for reasons other than a frosted coil.

Many heat pump expansion valves meter refrigerant to the outdoor coil depending on the heating demands sensed inside the building. These valves commonly include an expansion valve member driven between fully opened and closed positions by an electric motor and drive train which, in turn, are operated in response to sensed conditions. When the expansion valve first opens, the valve member can oscillate as the valve drive and condition-sensing devices seek a stable, appropriate setting. This "hunting" behavior of the valve member causes the outdoor heat exchange coil temperature to oscillate. If the oscillatory variations in coil temperature are large enough, the difference between sensed outdoor air temperature and sensed coil temperature become sufficiently great to indicate a defrost is necessary. This is caused by a temporarily unstable expansion valve and not by a frosted outdoor coil.

Expansion valve instability can cause the coil temperature to oscillate by more than 5° F. One solution to this temporary instability problem has been to increase the temperature differential threshold level required to begin defrosting the coil so that these fluctuations will not initiate a defrost. This solution has made the systems particularly insensitive to needs to defrost at low outdoor temperatures and, in addition, when the system refrigerant charge becomes low, the system will not be defrosted.

DISCLOSURE OF THE INVENTION

Defrost apparatus for use with a heat pump constructed in accordance with one embodiment of the invention includes a controller supported within a housing and having an input for monitoring thermostat signals generated in response to heating demands of a region in heat transfer relationship with a first heat exchanger. A first temperature sensor coupled to the controller determines a temperature of a second heat exchanger that gathers heat energy from ambient air for delivery by a refrigerant to the first heat exchanger and provides a first temperature signal to the controller. A second temperature sensor is mounted within the housing and monitors a temperature related to ambient temperature in a vicinity of the housing and provides a second temperature signal to the controller. Circuitry coupled to the controller defrosts the second heat exchanger at periodic intervals to remove accumulated ice from the second heat exchanger and thereby increase an efficiency of the second heat exchanger.

The controller determines a sensed temperature difference based on signals from the first and second temperature sensors after the second heat exchanger is defrosted and sufficient time has elapsed to allow the second heat exchanger to stabilize in temperature. The controller then re-calculates a threshold temperature difference based upon the sensed temperature difference for use in determining when to initiate a next subsequent defrost of the second heat exchanger.

A demand defrost controller constructed in accordance with the present invention monitors relative outdoor ambient temperature and outdoor heat exchanger coil temperature and uses compressor run-time to determine when a defrost cycle is required. After power-up of the controller or after a loss of power, a so-called sacrificial defrost operation is performed after a specified period of compressor run-time. During the specified period, the coil temperature must be below an enable temperature. In accordance with a preferred system, the compressor must run 34 minutes and the coil temperature must be below 35° F.

Once a defrost has been initiated, the coil temperature is monitored during the defrost. The defrost cycle is terminated either in response to the coil reaching a specified temperature or the defrost taking a specified period of time. If the defrost is concluded when the coil reaches its termination temperature or if the coil temperature was above 35° F. for more than 4 minutes even though terminated by time, a clear coil without frost can be assumed. If the defrost terminates on time without the 4-minute criteria being satisfied, another sacrificial defrost operation is performed after the compressor runs for 34 minutes with the coil temperature below 35° F.

Once a clear coil defrost condition is achieved and after a 4-minute delay to allow coil temperature to stabilize, coil and ambient temperatures are read over a period of time and averaged to determine a dry or clear coil difference in temperature between ambient and the outdoor heat exchanger coil. This difference in temperature is added to a temperature-dependent value and used as a threshold difference for use in determining when to initiate a next subsequent defrost. As the conditions for a next subsequent defrost are monitored, the controller continues to monitor ambient temperature and adjusts the calculated defrost criteria based upon sensed ambient temperature. This change in defrost criteria with temperature takes into account system capacity reductions due to changing ambient temperature. As the temperature decreases, the difference in temperature also decreases.

Use of an ambient temperature sensor on a printed circuit board inside a housing rather than outside the controller housing is cheaper and no less effective. The fact that temperature differences between ambient and coil are used means accuracy in temperature sensing is less important so long as relative changes in temperature are accurately sensed.

After initial calibration is complete, the controller disables a defrost cycle for a specified period to avoid unnecessary defrost operations. This so-called lock-out period can be adjusted and, in a preferred embodiment of the invention, is chosen to be 34 minutes.

Other objects, advantages and features of the invention are described below in conjunction with a description of a preferred embodiment of the invention.

BRIEF DESCRIPTION OF THE DRAWINGS

FIGS. 6A–6D show a detailed flow chart of a portion of the FIG. 4 control program;

BEST MODE OF CARRYING OUT THE INVENTION

Figure 1:
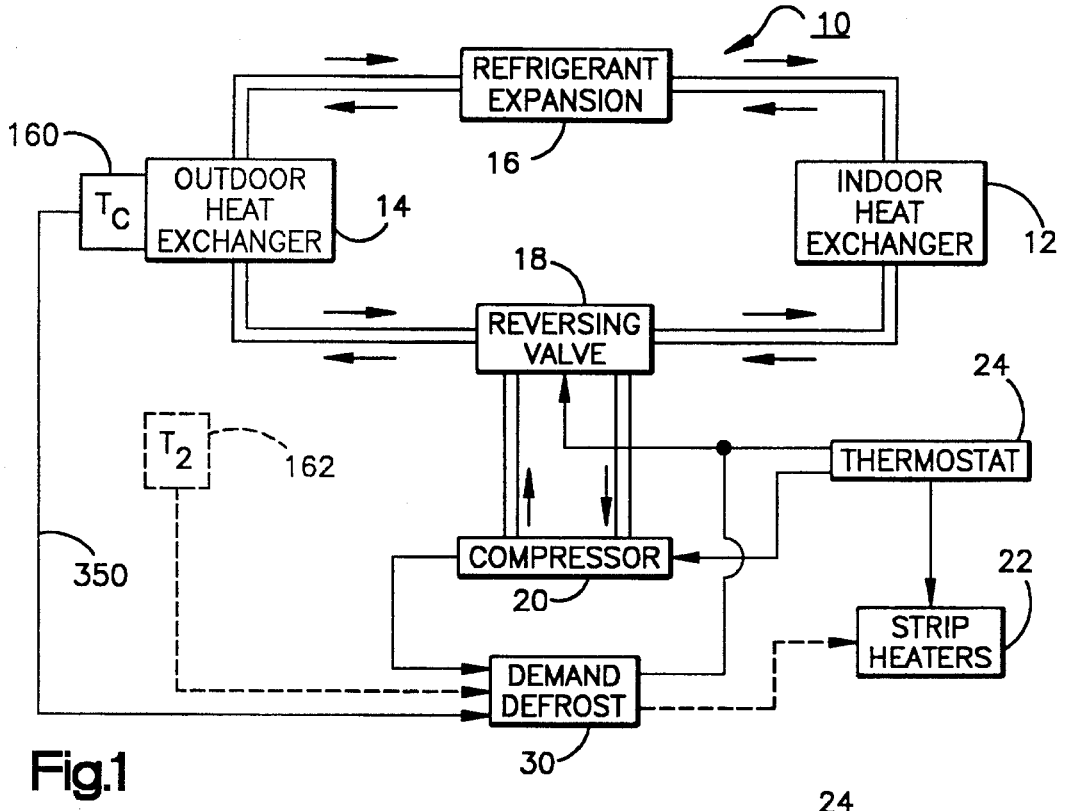
FIG. 1 is a diagrammatic representation of a heat pump system.

Turning now to the drawings, FIG. 1 illustrates a heat pump system 10 for heating or cooling the inside of a building. The heat pump system 10 includes an indoor heat exchanger 12, an outdoor heat exchanger 14, and an expansion device 16 coupled between the heat exchangers. Refrigerant is circulated through the system by a refrigerant compressor 20 with the refrigerant flow direction controlled by a flow reversing valve 18. The heat pump system 10 also includes electric resistance heaters 22 (called strip heaters) which are energized to heat the building whenever the heat pump system is not effective. The compressor 20 and strip heaters 22 are cycled on and off in response to control signals from a thermostat control unit 24. The unit 24 has a sensor responsive to indoor air temperature for producing an error signal having a value which depends upon the difference between sensed air temperature and a preselected set point temperature.

In the preferred embodiment of the invention, the thermostat unit 24 includes a manually actuated "change-over" switch (not illustrated). The change-over switch is operated to a "cooling" setting to position the reversing valve 18 so that the heat pump system cools the indoor air in response to cooling control signals from the thermostat 24. When the change-over switch is in its "heating" setting, the valve 18 is positioned to direct refrigerant flow for heating the indoor air and operation of the strip heaters is enabled. The heat pump and the strip heaters are operated under control of the thermostat unit 24 to heat the indoor air according to the sensed indoor air temperature.

The process of heating and cooling by a heat pump system is well known and will only be briefly summarized. In either the heating or cooling mode of operation, the compressor 20 receives gaseous refrigerant that has absorbed heat from the environment of one of the two heat exchangers 12, 14. The gaseous refrigerant is compressed by the compressor and discharged at high pressure and relatively high temperature to the other heat exchanger. Heat is transferred from the high pressure refrigerant to the environment of the other heat exchanger and the refrigerant condenses in the heat exchanger. The condensed refrigerant passes through the expansion device 16 into the first heat exchanger where the refrigerant gains heat, is evaporated and returns to the compressor intake.

Typical heat pump units of the sort referred to here are constructed using heat exchangers formed by tubular coils of highly conductive metal through which the refrigerant flows. Ambient air is directed across the coils to produce conductive heat transfer. The heat exchangers are thus referred to as coils, although they could take other forms if desirable.

When the heat pump 10 operates as an air-conditioning unit, the valve 18 is positioned to direct refrigerant flow so that the indoor coil 12 absorbs heat from the indoor air and the coil 14 gives off heat to the outdoor air. The thermostat 24 energizes the compressor 20 in response to sensed indoor air temperature above the thermostat setting and terminates compressor operation when the sensed indoor air temperature reaches the set point temperature.

When the heat pump 10 is operating as a heating unit, refrigerant is discharged from the compressor through the valve 18 to the indoor coil 12. The compressed gaseous refrigerant condenses in the coil 12 giving up heat to the indoor air. Fans (not shown) blow indoor air across the coil 12 and facilitate heat transfer from the coil to the air.

As the refrigerant gives up its heat content, it condenses and passes through the expansion device 16. The low pressure liquid refrigerant expands as it passes into the outdoor coil 14. The refrigerant in the outdoor heat exchange coil absorbs heat from the outdoor air and evaporates. The gaseous refrigerant then passes through the valve 18 back to the compressor intake.

The outdoor coil 14 is an energy absorber since the atmospheric air heats (and vaporizes) the refrigerant passing through the coil 14. Since the refrigerant in the outdoor coil is at a lower temperature than the atmospheric air, atmospheric moisture tends to condense onto the outdoor coil. When the coil temperature is at or below freezing temperature, the outdoor coil accumulates frost or ice over its outside surface. The accumulation of frost or ice impedes heat transfer from atmospheric air into the refrigerant, thus reducing the effectiveness of the heat pump system.

According to the present invention, conditions leading to the need for defrosting the outdoor coil are monitored so that the outdoor coil can be defrosted periodically when needed. The outdoor heat exchange coil 14 is de-iced or defrosted by reversing the flow of refrigerant through the heat pump 10 for a relatively short period of time so that hot refrigerant from the compressor is directed by the valve 18 to the outdoor coil 14. The flow of hot gaseous refrigerant heats the coil 14 and melts accumulated frost or ice on the coil's outside surface. When the coil is defrosted, the valve 18 reverses the system refrigerant flow direction again so that the heat pump resumes its heating function with renewed effectiveness.

The defrosting cycle of the heat pump system 10 is initiated and terminated by a self-calibrating defrost control circuit 30 in response to sensed conditions indicative of the need for performance of a defrosting cycle.

The control circuit 30 provides three interactive defrost cycle controls. The preferred control circuit 30 initiates a defrost cycle when: (1) the outdoor coil temperature is low enough to warrant defrosting; (2) a timed defrost control enables defrosting; and (3) a differential temperature responsive control enables defrosting.

Figure 7:
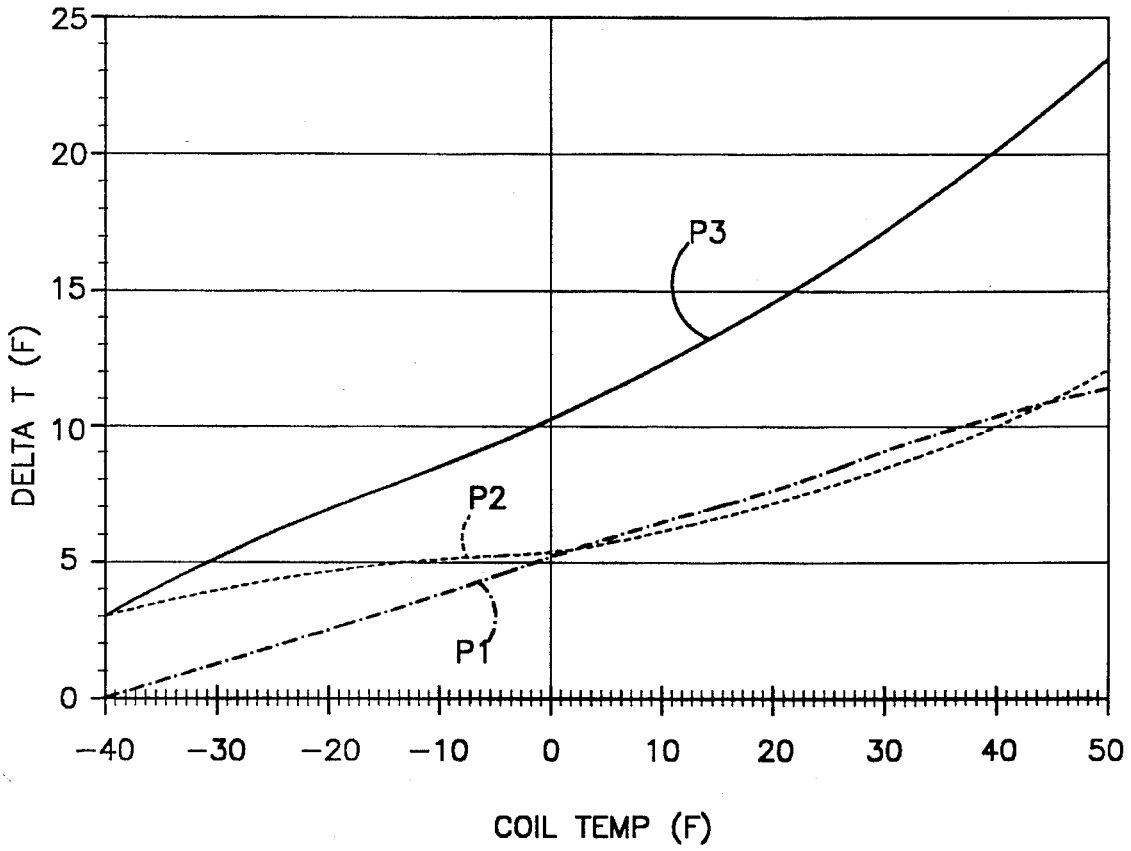
FIG. 7 is a graph showing temperature differences used to defrost for different sensed coil temperatures.

FIG. 7 illustrates a manner in which the temperature difference between ambient air temperature and outdoor coil temperature varies with coil temperature. A first plot P1 shows the temperature difference for a frost-free outdoor coil. As ambient air temperature decreases, the difference between ambient air temperature and the coil temperature decreases. A second plot P2 is a defrost variable that varies with temperature. At temperatures above about 0° F., this second plot varies approximately linearly, having a slope of 1 degree delta T for every 8 degrees in temperature. A third plot P3 is the combination of the first two plots P1, P2 and is a defrost criteria used by the control circuit 30 to initiate a defrost. If the outdoor heat exchanger coil is less than an enable temperature of 35° F., the compressor has been operating for a lock-out period of greater than 34 minutes, and if the sensed difference between ambient temperature and coil reaches the value (P3) shown in FIG. 7, a defrost of the coil is conducted.

CONTROL CIRCUIT 30

Figure 2:
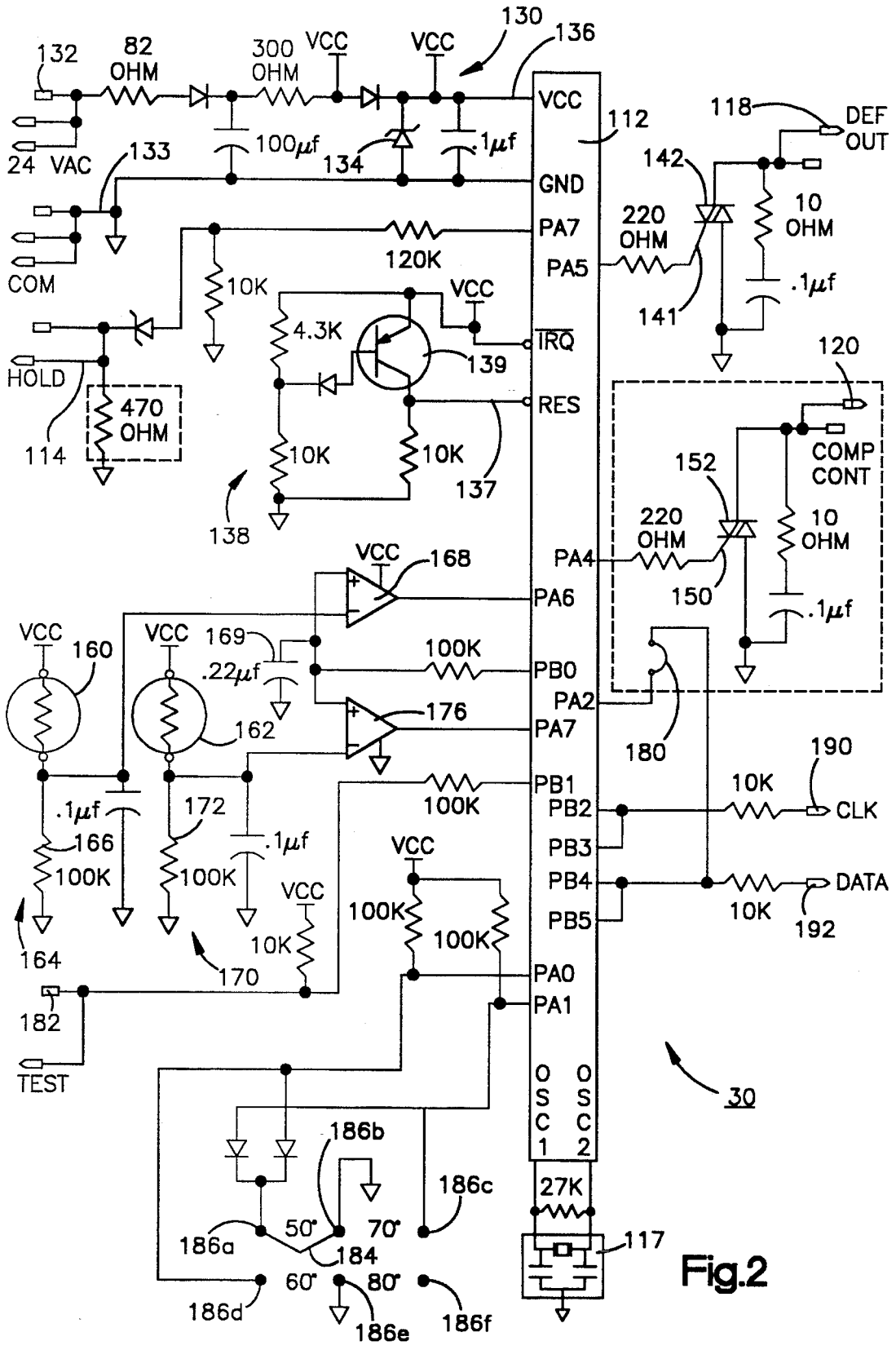
FIG. 2 is a detailed schematic of a heat pump demand defrost controller.

FIG. 2 is a detailed schematic of the defrost control circuit 30. The circuit 30 includes a programmable controller 112 that executes a control program for determining when to defrost an outdoor heat exchanger coil. The control circuit 30 includes an input 114 for monitoring a signal corresponding to heating and cooling requests placed upon the heat pump system by the thermostat 24. When the thermostat 24 places a heating or cooling demand on the heat exchanger, the hold input 114 receives an alternating 60-cycle signal. The programmable controller 12 counts AC line signal cycles presented at the hold input 14 and uses this count to time functions performed by the control program. Details concerning the timing of control functions by counting line cycles are found in U.S. Pat. No. 5,237,830 to Grant.

The operating program of the programmable controller 112 is stored in a ROM memory portion of the controller. The preferred programmable controller is a model MC68HC05J1 microprocessor commercially available from Motorola. A clock signal of 4 megahertz is provided by a ceramic resonator 117 coupled across input pins 0SC1, 0SC2 to the microprocessor. With the masked version of the same controller, the resonator 117 is removed and the internal oscillator of the controller is used. The timing technique described in U.S. Pat. No. 5,237,830 avoids timing inaccuracies due to use of the internal oscillator. When power is applied to the control circuit 30, the programmable controller 112 executes its control algorithm and cycles through a processing loop (described below) that monitors the input 114 and controls the status of two outputs 118, 120 from the control circuit 30. A first output 118 actuates a defrost cycle of the refrigeration system heat exchanger and a second output 120 is optionally used to de-activate the compressor 20 (FIG. 1) that circulates refrigerant through the refrigeration system.

The programmable controller 112 is coupled to a power supply 130 having two inputs 132, 133. The input 132 provides a 24-volt alternating current input signal and the input 133 is grounded. The 24-volt alternating current signal is derived from a step down transformer which converts 110-volt alternating current line voltage into the 24-volt alternating current signal for energizing the control circuit 30. The power supply 130 filters this signal to integrate the oscillating AC signal and couples a DC signal across a zener diode 134 having a breakdown voltage of 5 volts. This produces a 5-volt signal which is used throughout the control circuit 30 and is also coupled to a VCC input 136 to the programmable controller 112.

Until the 5-volt VCC signal reaches a minimum operating voltage (2 volts), a low reset signal is applied at a reset pin 137 of the controller 112 by a low-voltage indicator circuit 138. The signal at the reset pin 137 then goes high and remains high as long as VCC is greater than 2 volts. If VCC drops to less than 2 volts, a transistor 139 coupled to the reset pin 137 turns off and the signal at the reset pin 137 goes low.

In the disclosed embodiment of the invention, pin PA5 of the programmable controller 112 is set high to pull output 118 low and actuate a relay coil of a relay 140 (FIG. 3) for initiating a defrost cycle. The optional compressor inhibit output 120 is pulled low by setting pin PA4. In certain embodiments of the invention this output is used to inhibit activation of the compressor motor of the refrigeration system and prevent so called short cycling of the compressor motor.

The output 118 is pulled low by applying a high signal to a gate input 141 of a triac 142. When the gate input 141 goes high, the triac is rendered conductive and the output 118 pulled low to ground. In a similar fashion, an output from pin PA4 is coupled to a gate 150 of a triac 152. When the output at pin PA4 goes high, the gate signal turns on the triac 152 causing the contact 120 to be grounded.

Figure 3:
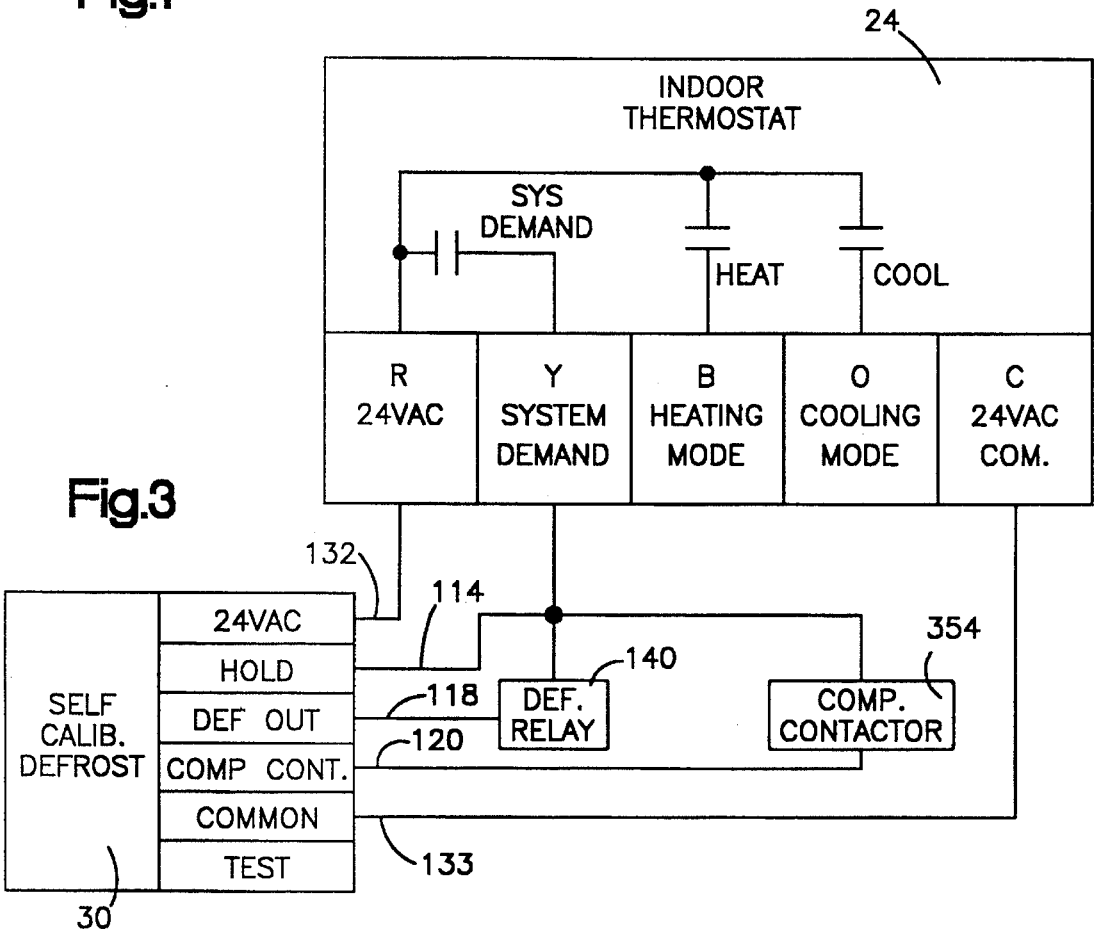
FIG. 3 is a schematic of a typical wiring diagram for a thermostat and the FIG. 2 controller.

The programmable controller 112 causes the refrigeration system to alternate between normal and defrost cycles by alternate energization and de-energization of the relay 140 (FIG. 3). Normal cycles are designated as "defrost off" intervals. The programmable controller 112 determines the time period for the "defrost off" intervals based upon sensed conditions with a maximum "defrost off" default time period of six hours of compressor run time.

The schematic of FIG. 2 shows two temperature sensors 160, 162 electrically connected to pins PA6, PA7 of the controller 112. A first sensor 160 is physically connected to the outdoor heat exchanger 14 (FIG. 1) and, more specifically, is coupled to a thermally conductive heat exchanger coil. A resistance of the sensor 160 changes with temperature and helps provide an output signal directly related to the temperature of the outdoor heat exchanger coil. The sensor 160 is most preferably constructed from a commercially available thermistor physically attached to the outdoor heat exchanger coil.

A second temperature sensor 162 is also constructed from a commercially available thermistor and is attached to a printed circuit board 163 that supports the programmable controller 112. The second sensor 162 is also used to provide a signal directly related to ambient temperature. Although the printed circuit board supporting the sensor 162 is mounted within a housing 165, increases and decreases in ambient temperature in close proximity to the outdoor heat exchanger correlate very closely to changes in temperature of the sensor 162.

A voltage divider 164 is formed from the combination of the sensor 160 and a resistor 166 coupled across the VCC signal. The output from the voltage divider 164 is a voltage directly related to outdoor heat exchanger coil temperature and is coupled to an inverting input (–) of an operational amplifier 168. As described below, the controller 112 toggles a pin PB0 back and forth between VCC and 0 volts to determine the magnitude of the output voltage from the voltage divider 164 and hence, the temperature of the sensor 160.

A second voltage divider 170 is formed from the combination of the sensor 162 and a resistor 172. This second voltage divider provides an input voltage to the inverting input (–) of a second operational amplifier 176. The controller 112 also monitors the voltage output from the voltage divider 170 to determine the temperature reading of the sensor 162 which is related to ambient temperature.

The control program of the programmable controller 112 can inhibit so-called short cycling of the compressor. If a jumper 180 is installed, the controller 112 monitors the periods that the compressor is not running. If a request to operate the compressor is made before expiration of the predetermined short cycle time, this request is ignored until expiration of the short cycle time period. A preferred short cycle inhibiting time is a period of 5 minutes.

Diagnostic testing of the circuit 30 is initiated by shorting a test contact 182 to pull pin PB1 of the controller low. When the controller 112 senses this condition it increments variables in software at a rate that causes the heat exchanger defrost on/off cycles to be speeded by a factor of 240.

The controller 112 terminates a defrost on one of two criteria: a) the defrost has occurred for a certain time period (in one embodiment, 14 minutes); or (b) the outside heat exchanger coil has reached a termination temperature that is sensed by the sensor 160. Controller pins PA0, PA1 are used to sense a selected defrost termination temperature. A jumper 184 is installed to bridge a selected pair of six contacts 186*a*–186*f*. These contacts 186*a*–186*f* allow four termination temperatures of 50, 60, 70 and 80 degrees Fahrenheit to be selected as the defrost termination temperature.

A serial communication port is provided at pins PB2, PB4 of the controller. A first output 190 generates a clock signal of alternating high and low signals. One bit of data is presented on a data output 192 that is read by a data gathering device such as a portable computer (not shown) on the rising or falling edge of the clock signal at the output 190. Presentation of data at the output 192 in synchronism with the clock signal at the output 190 is also performed by the controller's operating program.

OPERATING SYSTEM

Figure 4:
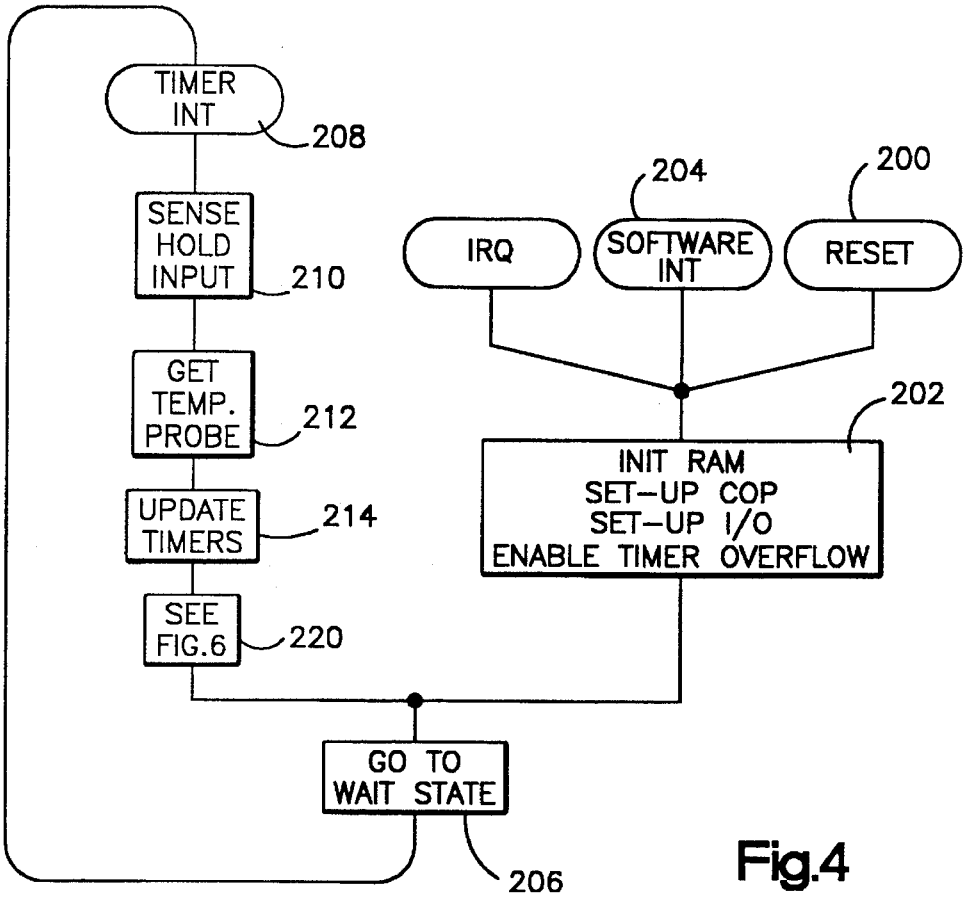
FIG. 4 is a flow chart depicting a control program for the demand defrost controller as the controller monitors heat pump operation.

Each time power is applied across the VCC and GND pins of the controller 112, a power-on reset 200 (FIG. 4) is performed and the controller jumps to a specific memory location to begin executing instructions. A flow control diagram illustrating the operations performed by these instructions is shown in FIG. 4. As seen in FIG. 4, the first step the controller 112 performs is an initialization step 202 where constants are initialized and memory is zeroed. Also, at this step 202 a timer is set up to monitor performance of the controller 112. A computer operating properly (COP) bit is set and if the operating system does not periodically clear that bit within a specified time, an internally generated software interrupt 204 is performed to re-synchronize the controller 112.

Table I below indicates certain variables and constants used by the control or operating system:

TABLE I

Variables

1. Short cycle count
2. Defrost count
3. Hold flag (1 bit)
4. Defrost flag (1 bit)
5. Temperature enabled flag (1 bit)
6. Test flag (1 bit)
7. 4-Second timer flag (1 bit)
8. Transient delay flag (1 bit)
9. Ambient temperatures (0–3)
10. Coil temperatures (0–3)

Constants

1. Short cycle time (5 minutes)
2. Defrost time (14 minutes)
3. Termination temperature (jumper selectable)

Subsequent to the initialization step 202, the programmable controller 112 enters a main loop by enabling its interrupts and entering a wait state 206. Each time a timer interrupt occurs (every 1024 clock cycles), the controller leaves the wait state 206 and enters a timer interrupt routine 208.

At a first step 210 of the timer interrupt routine, the controller 112 reads pin PA7 and looks for a transition of the signal at the hold input 114. If the AC input changes state, the controller 112 determines that the compressor is running and that various timing and monitoring functions should begin.

Once the controller 112 determines that the compressor is running, the controller 112 determines which of the two sensor 160, 162 is currently being sensed. The controller 112 monitors an input (pin PA6 or PA7) from one of these two sensors at a next step 212.

Figure 5:
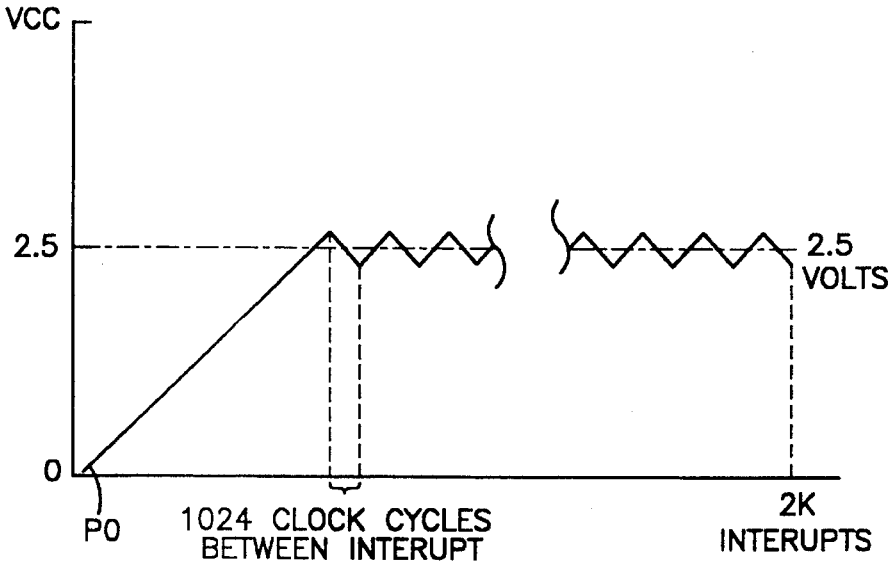
FIG. 5 is a graph showing voltage vs. time for an input to a comparator depicted in FIG. 2.

The controller 112 initiates the reading of a sensor by toggling pin PB0 high during a first pass through the interrupt handling routine and, on each next subsequent interrupt routines, determines a status of either pin PA6 or PA7. As an example, pin PA6 is monitored when the temperature of the sensor 160 is being determined. Referring to FIG. 5, the initial interrupt which toggles pin PB0 high is at a beginning point PO of a linear ramp in voltage that appears at the inverting input (–) of the operational amplifier 168. The ramp-up in voltage seen in FIG. 5 corresponds to charging of a capacitor 169 coupled to the operational amplifier when the voltage at pin PB0 goes high.

Each time an interrupt occurs, the controller checks the status of the output from the comparator 168 at pin PA6. As the capacitor 169 charges, the charge will eventually reach a voltage that surpasses the output from the voltage divider 164 and the output from the comparator 168 changes state. When this occurs, the controller 112, senses this change in state and toggles pin PB0 low and awaits a next subsequent change in output from the comparator 168.

As seen in FIG. 5, the time it takes (or the number of interrupts) the comparator output to change state the next time is significantly less. When the pin PB0 is toggled low, the voltages at the inverting and non-inverting inputs to the comparator 168 are approximately the same. On each next subsequent interrupt processing step, the controller determines whether the comparator 168 has changed state. If it has not, pin PB0 is maintained the same. If the output from the comparator 168 changes, the pin PB0 is again toggled. This process continues through a fixed number of interrupts while a count of the number of times the output has changed state is maintained. At the end of a fixed number of interrupts (in a preferred embodiment, 2,048 such interrupts), the controller correlates the number of times pin PB0 is high vs. the total number of interrupts to determine a temperature corresponding to the voltage from the voltage divider 164. The controller 112 alternately determines temperatures for the two sensors so long as the compressor is running.

Since 2,048 interrupts are required to determine the temperature of one probe, the microprocessor controller 112 is operating at a frequency of approximately 4 megahertz, and an interrupt occurs every 1024 clock cycles, it takes approximately one-half second for the temperatures of a sensor to be evaluated.

After reading the status of pin PA6 (and possibly toggling pin PB0), the controller 112 performs a step 214 of updating a hold input line cycle counter which is used in performing timing functions based on compressor operation. Each time a cycle counter reaches 255, a 4-second flag is set. Setting of the 4-second flag is checked in the main processing routine of FIGS. 6A–6D to update various counters used in performing the defrost control operation. The controller leaves the step 214 and enters a main processing routine of FIGS. 6A–6D each time an interrupt occurs.

Upon entering a main processing routine 220, the controller 112 first checks 222 to determine whether a flag corresponding to 4 seconds of compressor run-time has been set. If it has not been set, various timing functions do not need to be updated and the processor branches to a step for determining whether a defrost flag has been previously set (see FIG. 6C).

If the 4-second flag has been set, the processor sets a serial output flag 224, clears the 4-second flag 226 and increments a 30-second counter 228. The contents of the 30-second counter are checked at a step 229 of FIG. 6A and are used to switch back and forth between sensing coil and ambient temperatures. The controller next checks to determine 230 whether a timer delay flag has been set. If the timer delay flag is set, this means the compressor has been running less than a delay period (in one embodiment, 2 minutes) and temperatures within the system may not be stable. This means that various other steps performed by the controller should not be performed until this time delay has elapsed. If the time delay flag is set, the controller branches to a step 232 where a timer is incremented, and then determines 234 whether the delay count has been reached. If it has not, the controller branches past other decision-making steps of FIGS. 6A and 6B. If the delay count is reached at the step 232, the controller branches to a step 236 of clearing the time delay flag.

If the time delay flag was not set at the step 230, the controller determines 240 if a flag has been set indicating the outside heat exchanger coil is less than an enable temperature of 35° F. If the coil is below the enable temperature, a compressor run-time counter is incremented 242 and the controller then determines 244 whether an analog-to-digital conversion flag has been set. If the analog-to-digital temperature conversion process for a given sensor is not complete, the controller bypasses the functions performed in the flow diagram depicted in FIG. 6B. The analog-to-digital conversion flag is set by the temperature probe routine 212 discussed previously. At the step 229, the controller checks a 30-second counter that is incremented in the timer update routine 214. If this counter has exceeded 30 seconds, the controller switches temperature probes. If 30 seconds has not been reached, the controller bypasses the FIG. 6B processing steps.

Assume that the analog-to-digital conversion process has not been completed so that the tasks of FIG. 6B are not performed. The processor branches to a step 250 (FIG. 6C) to determine whether a defrost flag has been set. The defrost flag is set when the controller has made a determination that a defrost is needed based upon sensed criteria. If the defrost flag is set, the controller determines at a step 252 whether the hold flag is high indicating the compressor is running. If the hold flag is high, the defrost output at pin PA5 is set at a step 260 to assure that the defrost condition is maintained. The controller then checks 262 to determine if the defrost period has exceeded 14 minutes. If the defrost period exceeds 14 minutes, the defrost may be terminated even if the coil may not be clear of ice. If the defrost time period is less than 14 minutes, the controller checks 264 to determine whether the coil temperature is greater than a termination temperature corresponding to a clear coil. This termination temperature is initialized during set up of the microprocessor from the status of the jumper 184 and is set to a termination temperature determined during factory set-up of the controller.

If 14 minutes of defrost time is reached, an additional test 263 is performed. This test 263 is performed to see if the outdoor heat exchanger coil temperature was more than the enable temperature (as indicated by a "temp enabled flag") for a period of more than 4 minutes during the defrost. If the coil temperature was greater than the enable temperature for 4 minutes, a clear coil is assumed even though the compressor ran for 14 minutes in defrost mode without causing the outdoor coil to reach the termination temperature.

At the end of each defrost cycle, the controller must determine criteria for initiating a next subsequent defrost. Each time the controller terminates a defrost, a number of counters and flags are adjusted at the steps 265–270. Additionally, if the defrost is terminated on conditions that indicate a clear coil was achieved, two flags are set 271, 272 before the post-defrost steps 265–270 are performed. One of these flags is called the "Set Calc New Delta Flag" and is checked by the controller during processing of the next interrupt. If the flag is set at the step 272, a new defrost delta T (temperature difference) is calculated when the controller reaches a step 280 in FIG. 6B that is based upon the present coil temperature.

Returning to FIG. 6C, one sees that at the end of a defrost, the defrost flag is cleared at a step 266. When the controller reaches the decision step 250 (FIG. 6C) upon the occurrence of the next interrupt, the negative branch is taken and the defrost control pin PA5 is turned off at a step 281. Each time the controller branches to the negative path at the step 250 (meaning the defrost flag is not set ), it performs a number of decision steps 282–286. The first step 282 assures the lock-out time of 34 minutes has been reached before a defrost is initiated. The step 286 is where the controller branches to the step 288 of setting the defrost flag if the measured temperature difference between coil and ambient is greater than the calculated threshold difference of FIG. 7.

Figure 6A:
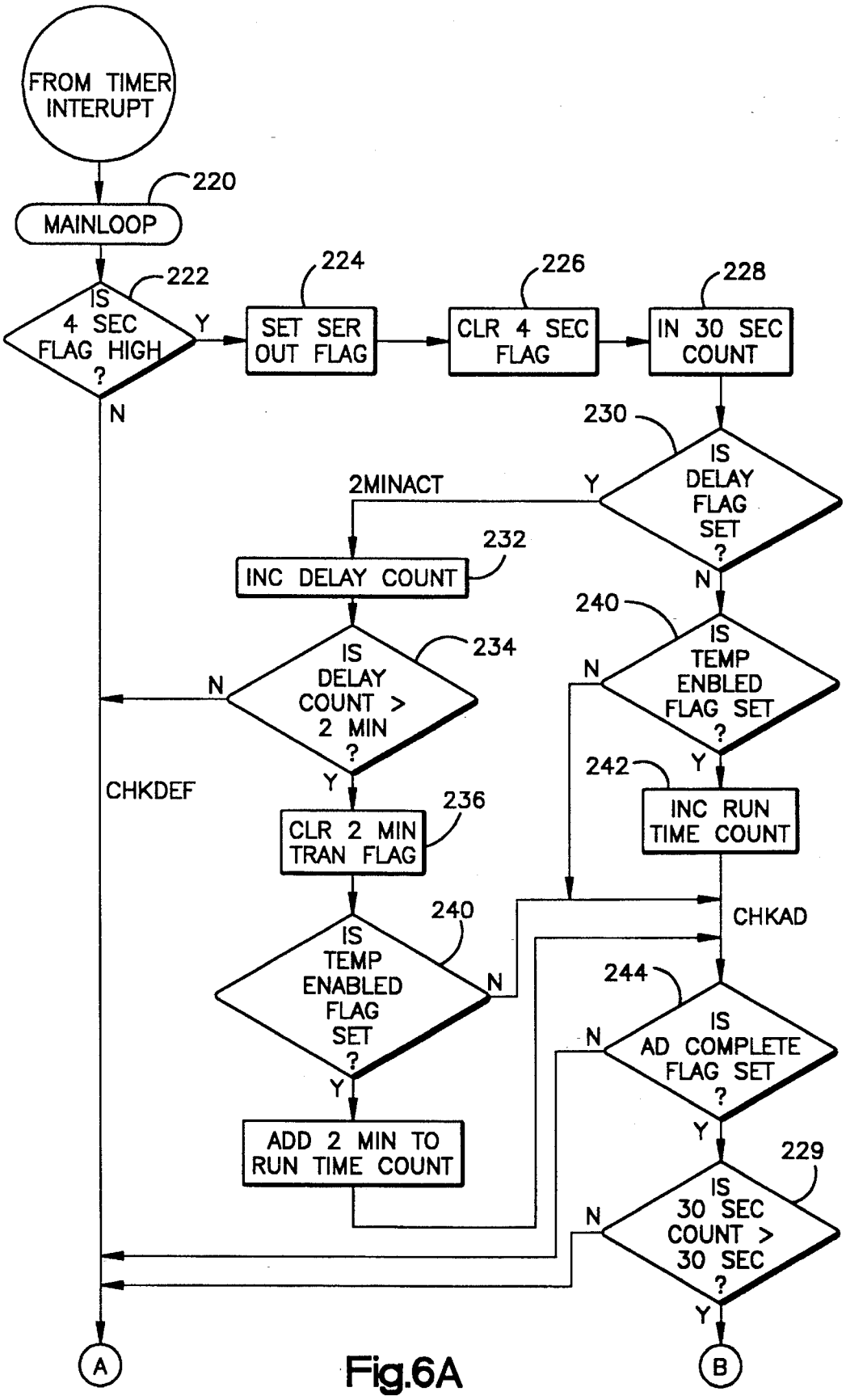

Returning to the flow chart of FIG. 6B, the controller 112 reaches this segment of the control program each time a period of compressor run-time reaches 30 seconds as determined at the step 229 of FIG. 6A. The controller initializes memory used to store coil temperatures to a constant value of A5A5 (hex) during initialization. A valid temperature reading is less then this constant. If a test 290 shows the oldest coil temperature reading is still equal to A5A5, a flag is cleared 291 and data moved in RAM locations 292. If all coil readings are valid data, the "AVG coil" flag is set 293 and RAM values re-arranged at the step 292. The controller next calculates 295 a measured delta T based on sensed conditions and then clears variables at the steps 296–299.

The next section of control program code either sets 300 the "temp enabled flag" or clears 301 this flag and branches to the FIG. 6C control. Setting the "temp enabled flag" occurs if the controller determines 302 the average outdoor coil temperature is less than 35° F. and cleared otherwise.

Figure 6D:
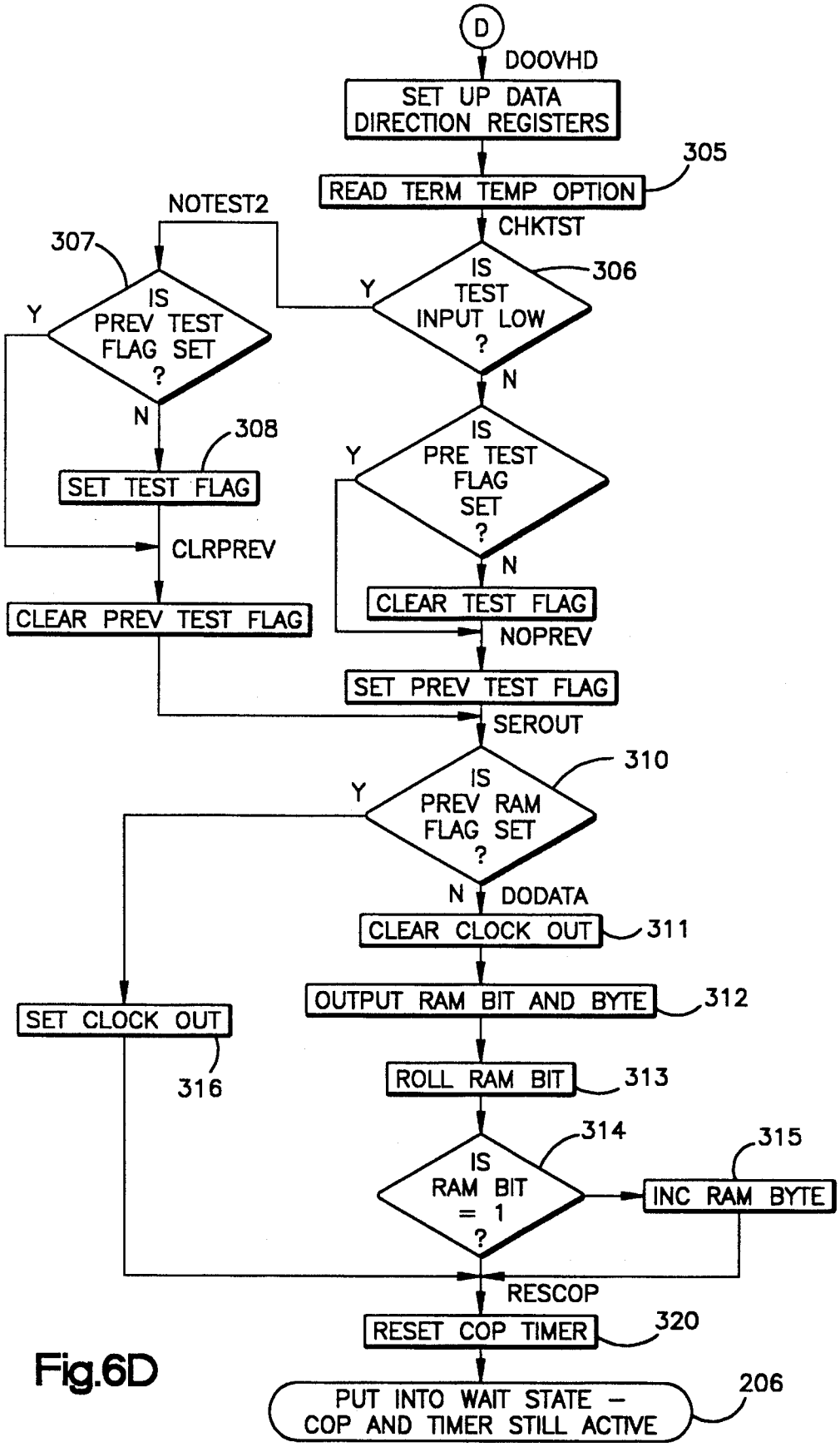

The flow diagram of FIG. 6D is the portion of the controller operating system that tests the test input at pin PB1 and outputs RAM data at the output 192. At a step 305, the termination temperature is read at pins PA0, PA1. The controller 112 next determines 306 if the test input at pin PB1 is low. If it is low, a test 307 debounces this input and sets a test flag bit at a step 308. Steps 310–316 transmit data from the serial outputs 190, 192.

The last step 320 executed by the main operating loop is to reset the computer operating properly (COP) bit and branch to the wait state 206. If it has not been cleared and a COP time period has expired, the computer operating properly routine 320 executes a reset of the controller and initialization takes place. If, however, everything is operating properly, the computer operating properly bit is reset and a branch is made to the wait state 206 until the next timer interrupt occurs.

In operation, the microprocessor executes the main operating loop again and again upon receipt of an interrupt. Once the hold input is actuated by the thermostat, the controller 112 cycles the heat pump between normal operating mode and defrost mode based upon the timed and sensed temperature conditions.

Figure 8:
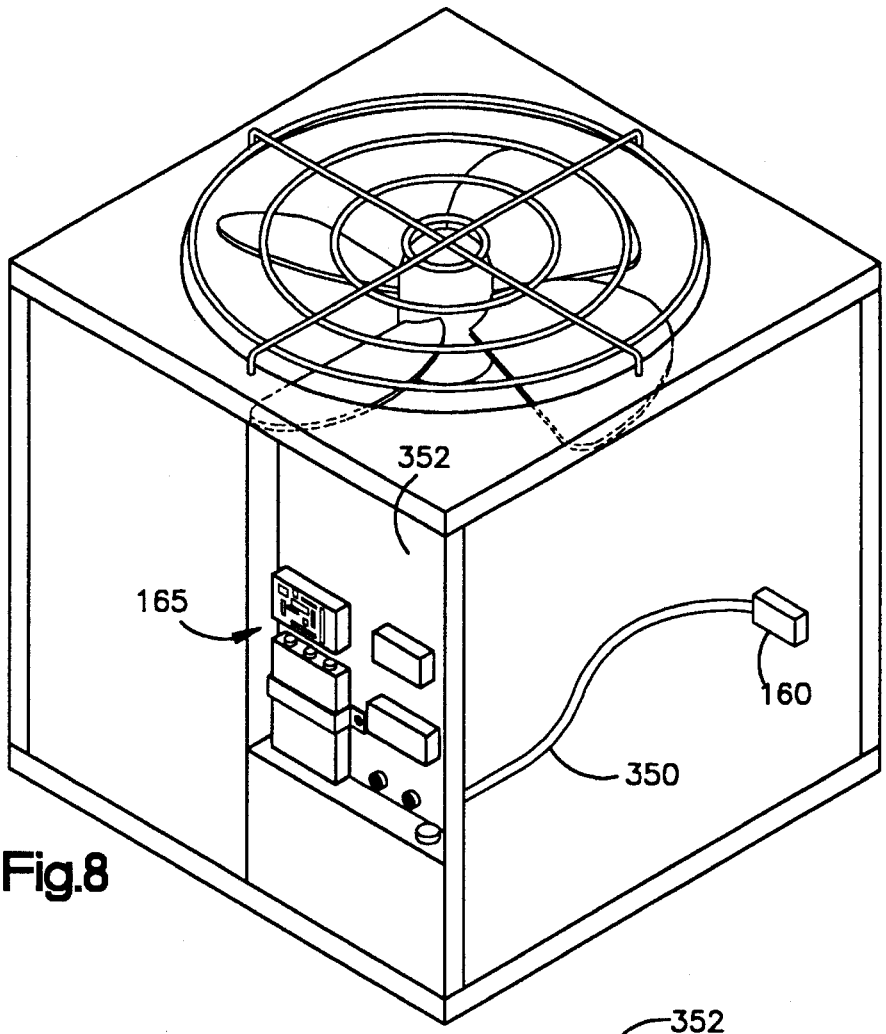
FIG. 8 is a perspective view of a heat pump showing a printed circuit board for a heat pump controller that also supports an ambient temperature sensor within a control circuit housing.
Figure 8A:
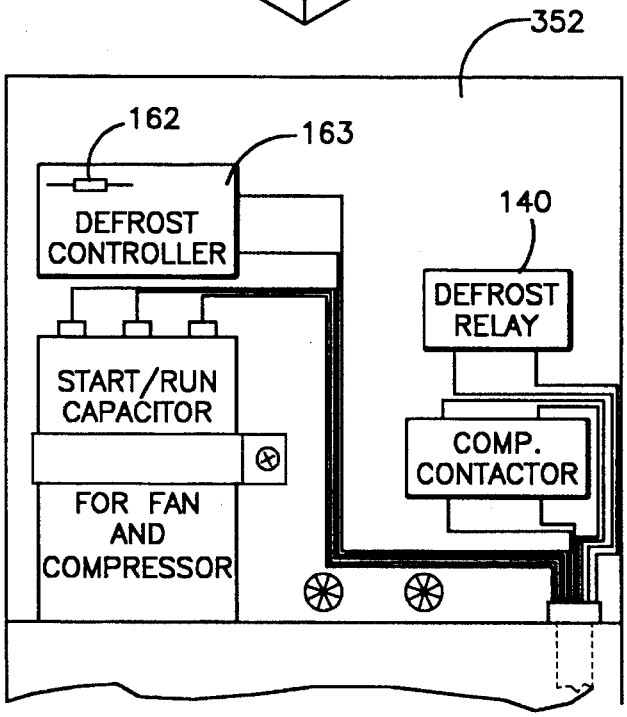
FIG. 8A is a plan view showing the control circuit printed circuit board.

FIGS. 8 and 8A show a heat pump and location of the housing 165 for the control circuit 30. The heat pump walls define an enclosure for the printed circuit board 163 and a mounting surface. Cabling 350 is routed through an inner wall 352 of the enclosure and to a location where the coil temperature sensor 160 attaches to the outdoor heat exchanger coil. The enclosure also encloses the relay 140 and a compressor contactor 354 for implementing the short cycle control option.

The present invention has been described with a degree of particularity. It is the intent, however, that the invention include all modifications from this deferred embodiment falling within the spirit or scope of the appended claims.

We claim:

1. Defrost apparatus for use with a heat pump comprising:

a) a controller mounted within a housing, the controller including an input for monitoring thermostat signals generated in response to heating demands of a region in heat transfer relationship with a first heat exchanger;

b) a first temperature sensor coupled to the controller, the first temperature sensor for determining a temperature of a second heat exchanger that gathers heat energy from ambient air for delivery by a refrigerant to the first heat exchanger and for providing a first temperature signal to the controller;

c) a second temperature sensor mounted within the housing and coupled to the controller., the second temperature sensor for monitoring a temperature related to ambient temperature in a vicinity of the housing and for providing a second temperature signal to the controller; and d) defrost circuitry coupled to the controller for defrosting the second heat exchanger in response to initiation of a defrost cycle by the controller, wherein said controller determines a first temperature difference from the first and second temperature sensors after termination of a first defrost cycle and determines a threshold temperature difference based on said first temperature difference for use in initiating a second defrost cycle.

2. The apparatus of claim 1 wherein the controller adjusts the threshold temperature difference based upon the second temperature signal.

3. The apparatus of claim 1 wherein the controller initiates a defrost cycle to defrost the second heat exchanger based upon periods of refrigerant flow following a just prior defrost cycle.

4. The apparatus of claim 1 wherein the controller conducts a sacrificial defrost upon reset of the controller by initiating a sacrificial defrost cycle after a specified period of refrigerant flow through the second heat exchanger.

5. The apparatus of claim 1 wherein the controller averages multiple temperature readings from the first and second temperature sensors after the first defrost cycle to determine the first temperature difference.

6. The apparatus of claim 1, comprising a circuit board for mounting the controller and the second temperature sensor in the housing.

7. The apparatus of claim 1, wherein the controller terminates the first defrost cycle after a first predetermined amount of time and initiates another defrost cycle if the temperature of the second heat exchanger was less than a predetermined temperature for more than a second predetermined amount of time during the first defrost cycle.

8. The apparatus of claim 7, wherein the controller initiates the other defrost cycle after a third predetermined amount of time following the termination of the first defrost cycle.

9. The apparatus of claim 1, wherein the controller terminates the first defrost cycle if the temperature of the second heat exchanger exceeds a predetermined termination temperature.

10. The apparatus of claim 9, comprising selectable switches coupled to the controller for determining the termination temperature.

11. A method of defrosting a heat pump heat exchanger comprising the steps of:

a) attaching a first temperature sensor to an outdoor heat exchanger to monitor a temperature of the outdoor heat exchanger and mounting a second temperature sensor in proximity to the outdoor heat exchanger to monitor a second temperature;

b) activating a heat pump compressor in response to a heating demand signal from a thermostat to cause refrigerant to flow through an indoor heat exchanger and transfer heat energy from the indoor heat exchanger to a region;

c) initiating a first defrost cycle to defrost the outdoor heat exchanger and determining a temperature difference between the temperature of the outdoor heat exchanger and the second temperature after the first defrost cycle;

d) setting a defrost condition for initiation of a second defrost cycle based upon the determined temperature difference, wherein the first defrost cycle is performed either for a first specified period of compressor run-time during the first defrost cycle or until the outdoor heat exchanger reaches a termination temperature, and wherein, in the event the first defrost cycle is terminated after the first specified period of compressor run-time, a subsequent defrost Cycle is initiated after a second specified period of compressor run-time if the outdoor heat exchanger was not above a specified temperature for a third specified period of time during the first defrost cycle.

12. An apparatus for defrosting a heat exchanger, the apparatus comprising:

(a) a first temperature sensor for sensing a temperature of the heat exchanger and for providing a first temperature signal corresponding to the temperature of the heat exchanger;

(b) a second temperature sensor for sensing a temperature corresponding to a temperature of ambient air in a vicinity of the heat exchanger and for providing a second temperature signal corresponding to the temperature of the ambient air; and (c) a controller coupled to the first temperature sensor and to the second temperature sensor, the controller for initiating a sacrificial defrost cycle upon reset of the controller and for determining a threshold temperature difference based on the first temperature signal and the second temperature signal after the sacrificial defrost cycle, wherein the controller monitors the first temperature signal and the second temperature signal after the sacrificial defrost cycle and initiates a subsequent defrost cycle to defrost the heat exchanger based at least on the monitored first temperature signal, the monitored second temperature signal, and the threshold temperature difference.

13. The apparatus of claim 12, wherein the controller initiates the sacrificial defrost cycle after a predetermined amount of time following the reset of the controller.

14. The apparatus of claim 12, wherein the controller adjusts the threshold temperature difference based on monitored second temperature signals.

15. The apparatus of claim 12, wherein the controller initiates a subsequent defrost cycle only after a predetermined amount of time following a prior defrost cycle.

16. The apparatus of claim 12, wherein the controller initiates a subsequent defrost cycle after a predetermined amount of time following a just prior defrost cycle.

17. The apparatus of claim 12, wherein the controller averages a plurality of monitored first temperature signals and a plurality of monitored second temperature signals to determine the threshold temperature difference.

18. A method for defrosting a heat exchanger, the method comprising the steps of:

(a) sensing a temperature of the heat exchanger and providing a first temperature signal corresponding to the temperature of the heat exchanger;

(b) sensing a temperature corresponding to a temperature of ambient air in a vicinity of the heat exchanger and providing a second temperature signal corresponding to the temperature of the ambient air;

(c) resetting a controller that monitors the first temperature signal and the second temperature signal;

(d) initiating a sacrificial defrost cycle upon the reset of the controller;

(e) determining a threshold temperature difference based on the first temperature signal and the second temperature signal after the sacrificial defrost cycle; and (f) monitoring the first temperature signal and the second temperature signal after the sacrificial defrost cycle and initiating a subsequent defrost cycle to defrost the heat exchanger based at least on the monitored first temperature signal, the monitored second temperature signal, and the threshold temperature difference.

19. The method of claim 18, wherein the initiating step (d) includes the step of initiating the sacrificial defrost cycle after a predetermined amount of time following the reset of the controller.

20. The method of claim 18, comprising the step of adjusting the threshold temperature difference based on second temperature signals monitored in the monitoring step (f).

21. The method of claim 18, comprising the step of initiating a subsequent defrost cycle only after a predetermined amount of time following a prior defrost cycle.

22. The method of claim 18, comprising the step of initiating a subsequent defrost cycle after a predetermined amount of time following a just prior defrost cycle.

23. The method of claim 18, wherein the determining step (e) includes the step of averaging a plurality of first temperature signals and a plurality of second temperature signals to determine the threshold temperature difference.

24. An apparatus for defrosting a heat exchanger, the apparatus comprising:

(a) a first temperature sensor for sensing a temperature of the heat exchanger and for providing a first temperature signal corresponding to the temperature of the heat exchanger;

(b) a second temperature sensor for sensing a temperature corresponding to a temperature of ambient air in a vicinity of the heat exchanger and for providing a second temperature signal corresponding to the temperature of the ambient air; and (c) a controller coupled to the first temperature sensor and to the second temperature sensor, the controller for initiating a first defrost cycle to defrost the heat exchanger based at least on the first temperature signal and the second temperature signal and for terminating the first defrost cycle after a first predetermined amount of time, wherein the controller initiates a second defrost cycle to defrost the heat exchanger if the temperature of the heat exchanger was less than a predetermined temperature for more than a second predetermined amount of time during the first defrost cycle.

25. The apparatus of claim 24, wherein the controller initiates the second defrost cycle after a third predetermined amount of time following the termination of the first defrost cycle.

26. The apparatus of claim 24, wherein the controller terminates the first defrost cycle if the temperature of the heat exchanger exceeds a predetermined termination temperature.

27. The apparatus of claim 26, comprising selectable switches coupled to the controller for determining the termination temperature.

28. A method for defrosting a heat exchanger, comprising the steps of:

(a) sensing a temperature of the heat exchanger and providing a first temperature signal corresponding to the temperature of the heat exchanger;

(b) sensing a temperature corresponding to a temperature of ambient air in a vicinity of the heat exchanger and providing a second temperature signal corresponding to the temperature of the ambient air;

(c) initiating a first defrost cycle to defrost the heat exchanger based at least on the first temperature signal and the second temperature signal;

(d) terminating the first defrost cycle after a first predetermined amount of time; and (e) initiating a second defrost cycle to defrost the heat exchanger if the temperature of the heat exchanger was less than a predetermined temperature for more than a second predetermined amount of time during the first defrost cycle.

29. The method of claim 28, wherein the initiating step (e) includes the step of initiating the second defrost cycle after a third predetermined amount of time following the termination of the first defrost cycle.

30. The method of claim 28, wherein the terminating step (d) includes the step of terminating the first defrost cycle if the temperature of the heat exchanger exceeds a predetermined termination temperature.

31. The method of claim 30, comprising the step of determining a setting of selectable switches to determine the termination temperature.

* * * * *